United States Patent [19]

Sedam

[11] Patent Number: 4,679,707

[45] **Date of Patent: * Jul. 14, 1987**

[54] POST-MIX BEVERAGE DISPENSER APPARATUS HAVING FRONT ACCESS FOR LOADING SYRUP, $CO_2$ AND WATER

[75] Inventor: Jason K. Sedam, Dunwoody, Ga.

[73] Assignee: The Coca-Cola Company, Atlanta, Ga.

[ * ] Notice: The portion of the term of this patent subsequent to Jan. 15, 2001 has been disclaimed.

[21] Appl. No.: 697,899

[22] Filed: Feb. 4, 1985

Related U.S. Application Data

[60] Division of Ser. No. 634,044, Jul. 24, 1984, Pat. No. 4,497,348, which is a continuation of Ser. No. 320,476, Nov. 12, 1981, abandoned, which is a continuation-in-part of Ser. No. 277,806, Jun. 26, 1981, Pat. No. 4,357,284.

[51] Int. Cl.[4] ..... B67D 5/56

[52] U.S. Cl. ..... 222/129.1; 222/183; 222/146.6; 222/325

[58] Field of Search ..... 222/129.1, 129.2, 129.3, 222/129.4, 182, 183, 146.6, 325

[56] References Cited

U.S. PATENT DOCUMENTS

| | | | |
|---|---|---|---|
| 2,462,019 | 2/1949 | Bowman | 222/129.4 |
| 2,746,641 | 5/1956 | King . | |
| 2,750,076 | 6/1956 | Welty et al. . | |
| 2,978,143 | 4/1961 | Arnett et al. . | |
| 3,195,779 | 7/1965 | Nicko . | |
| 3,220,334 | 11/1965 | Martin . | |
| 3,266,672 | 8/1966 | Dean | 222/129.1 |
| 3,280,591 | 10/1966 | Webster . | |
| 3,312,083 | 4/1967 | Scoggins et al. . | |
| 3,343,726 | 9/1967 | Johanningmeier . | |
| 3,385,201 | 5/1968 | Martin . | |
| 3,462,970 | 8/1969 | Natter . | |
| 3,572,054 | 3/1971 | Curcio . | |
| 3,793,934 | 2/1974 | Martin . | |
| 3,851,797 | 12/1974 | Jacobs | 222/129.4 |
| 3,940,919 | 2/1976 | Kross et al. . | |
| 3,955,713 | 5/1976 | Hurley | 222/129.4 |
| 3,985,272 | 10/1976 | Rodth . | |
| 4,094,233 | 6/1978 | Martin . | |
| 4,316,557 | 2/1982 | Benoun et al. | 222/129.1 |
| 4,323,171 | 4/1982 | Whorton, III et al. . | |
| 4,355,735 | 10/1982 | Whorton, III . | |
| 4,440,318 | 4/1984 | Berger . | |
| 4,493,441 | 1/1985 | Sedam et al. | 222/129.1 |
| 4,496,080 | 1/1985 | Farber et al. | 222/129.3 |
| 4,520,950 | 6/1985 | Jeans . | |

FOREIGN PATENT DOCUMENTS

| | | | |
|---|---|---|---|
| 0022589A2 | 1/1981 | European Pat. Off. . | |
| 0027880 | 6/1981 | European Pat. Off. | 222/183 |
| 7838836 | 4/1979 | Fed. Rep. of Germany . | |
| 2855839 | 6/1980 | Fed. Rep. of Germany . | |
| 7930729.2 | 3/1981 | Fed. Rep. of Germany . | |

*Primary Examiner*—F. J. Bartuska
*Assistant Examiner*—Gregory L. Huson
*Attorney, Agent, or Firm*—Birch, Stewart, Kolasch & Birch

[57] ABSTRACT

A Post-mix beverage dispenser cabinet including a carbonator, water reservoir, flavor concentrate containers and a $CO_2$ cylinder disposed therein. The flavor concentrate containers and $CO_2$ cylinder are disposed adjacent a front wall of the cabinet. A water entrance chute extends from the front wall to the water reservoir. The flavor concentrate containers, $CO_2$ cylinder and water may be manually introduced at the front wall of the cabinet.

8 Claims, 6 Drawing Figures

POST-MIX BEVERAGE DISPENSER APPARATUS HAVING FRONT ACCESS FOR LOADING SYRUP, $CO_2$ AND WATER

BACKGROUND OF THE INVENTION

This application is a divisional application of Ser. No. 634,044, filed July 24, 1984, now U.S. Pat. No. 4,497,348, which is a continuation of Ser. No. 320,476, filed Nov. 12, 1981 (now abandoned), which is a continuation-in-part application of applicant's prior application Ser. No. 277,806, filed June 26, 1981, which is now U.S. Pat. No. 4,357,284.

The present invention relates to post-mix beverage dispensers which are compact, portable and suitable for use in small offices or small volume locations. More specifically, the present invention relates to a compact post-mix beverage dispenser unit which may be disposed on a counter top in the above-mentioned environments and supplied with water from a pitcher, syrup from disposable sealed packages and $CO_2$ for carbonation from refillable containers in a rapid and efficient manner.

Heretofore, the majority of commercially-available post-mix beverage dispenser units have been designed for large volume commercial uses such as in fast food restaurants. Because of these large volume uses, design criteria have emphasized optimum cooling and dispenser speed rather than low unit cost, size and portability. Although some consideration has been given to cost, size and portability even in these large volume commercial units, the resulting unit designs are generally far too expensive, bulky and heavy for small volume use.

Some attempts have been made in the beverage dispenser industry to reduce the cost, size and weight of these units to make them available for use by the general public. However, the units designed heretofore have lacked sufficient cooling capacity, dispensing efficiency, beverage quality and reliability as a trade off to achieving the aforementioned low cost, size and portability needed for consumer acceptance.

In order to be accepted by the small volume consumer, post-mix dispenser units must be easy to set up for use, compact, lightweight, easily repaired, reliable and, most importantly, inexpensive. In addition, the syrup, water and $CO_2$ supplies must be quickly and easily replenished during use by an unskilled consumer. Although attempts have been made to design post-mix beverage dispenser units possessing the foregoing criteria, the design of such a unit has not been totally achieved prior to the invention described hereinafter.

SUMMARY OF THE INVENTION

Accordingly, it is a primary object of the present invention to provide a portable, low cost, miniature post-mix beverage dispenser unit suitable for use in small offices or low volume locations.

It is a further object of the present invention to provide a post-mix beverage dispenser unit with cabinetry features which facilitate rapid set-up, loading and replenishing of the syrup, water and $CO_2$ to be used in making the beverages from the front of the cabinet.

The objects of the present invention are fulfilled by providing a post-mix beverage dispenser unit comprising: a cabinet having front, side, back, top and bottom walls; a carbonator; a manually refillable water reservoir within the cabinet for supplying water to said carbonator, said water reservoir having entrance opening means contiguous to said front wall for receiving a manually introduced water supply; at least one replaceable flavor concentrate container disposed contiguous to said front wall; at least one replaceable $CO_2$ cylinder disposed contiguous to said front wall for supplying $CO_2$ gas to said carbonator; access means for the water entrance opening means flavor concentrate container, and $CO_2$ cylinder, permitting water, flavor concentrate containers and $CO_2$ cylinders to be introduced into said cabinet at the front wall thereof; and a dispensing station at said front wall for delivering a post-mix, carbonated beverage formed from a mixture of flavor concentrate and carbonated water.

BRIEF DESCRIPTION OF THE DRAWINGS

The objects of the present invention and the attendant advantages thereof become more readily apparent by reference to the accompanying drawings, wherein.

DETAILED DESCRIPTION OF THE PREFERRED EMBODIMENTS

Cabinetry Construction and General Component Arrangement

Figure 1:
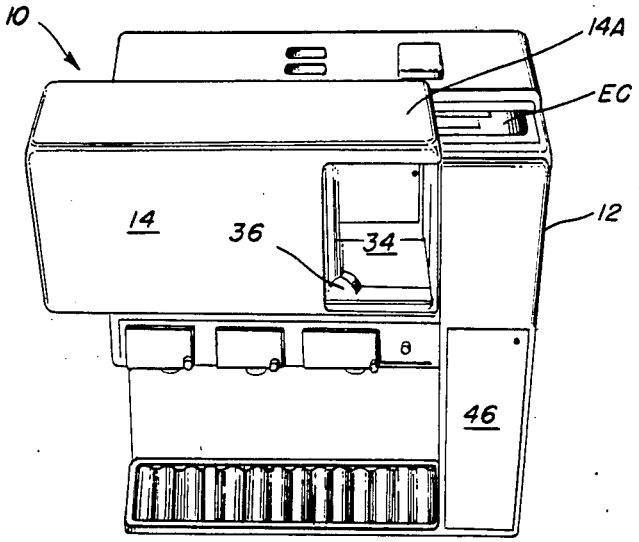
FIG. 1 is a front perspective view showing a front access panel of the cabinet of the dispenser unit of the present invention in an open position to expose the water entrance chute and syrup supply compartment.
Figure 2:
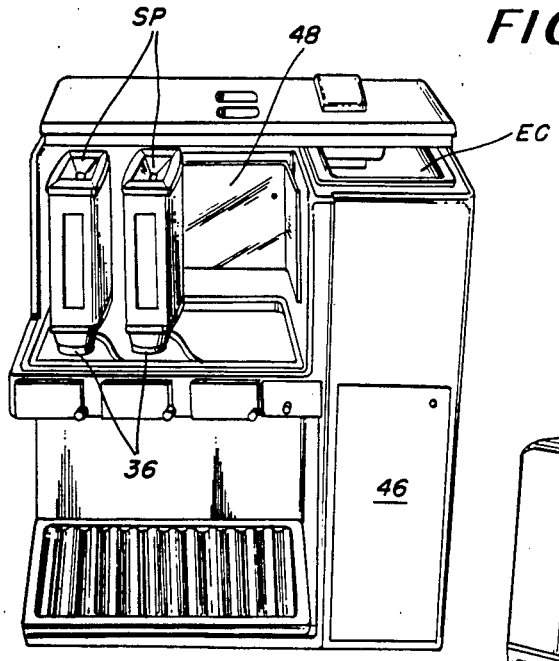
FIG. 2 is a front perspective view with the front access panel completely removed, illustrating how syrup containers are plugged into the syrup supply compartment of the present invention.
Figure 3:
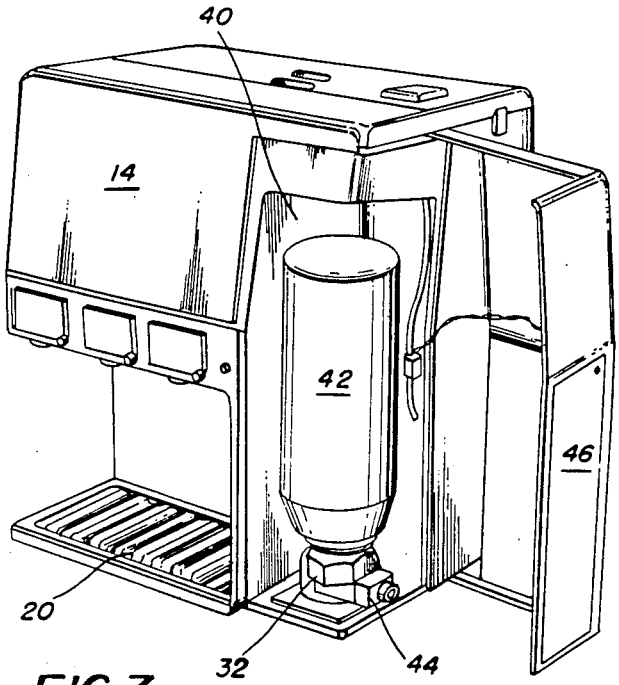
FIG. 3 is a front perspective view illustrating the $CO_2$ supply compartment of the dispenser cabinet of the present invention in an open position, illustrating how $CO_2$ cylinders may be plugged into the $CO_2$ supply compartment.

The cabinetry construction and the general arrangement of the components of the post-mix beverage dispenser unit of the present invention are illustrated in FIGS. 1 to 3. Referring in detail to these Figures, there is illustrated the post-mix beverage unit of the present invention generally designated 10, including a main cabinet portion 12 having front, back, side, top and bottom walls disposed at right angles to each other to provide a generally cubicle shape. A front access panel 14 is slidably mounted on the main cabinet portion 12 in suitable tracks to provide selective access to a water entrance chute EC and a syrup supply compartment 34. The front access panel 14 is so configured that it forms a flush corner of the final cabinet design in its closed position. That is, removable panel 14 has major surfaces parallel to the top, front and left side of the main cabinet portion 12 so that it wraps around and defines a corner of overall cabinet surface of the unit in the closed position. The front panel 14 is provided with an extension surface 14A in the plane of the top wall of the main cabinet 12 which covers water entrance chute EC in the closed position and may be selectively removed to uncover the entrance chute EC in an open position. In this position illustrated in FIG. 1, an associated water reservoir WR (FIG. 5) can be manually filled with water from a pitcher by pouring water into entrance chute EC. However, it is advantageous to close off entrance chute EC from the atmosphere when water is not being introduced into the unit for sanitary reasons.

An additional access panel 46 is provided in the lower right-hand corner of the dispenser unit of the present invention, as viewed in FIGS. 1 to 3. In the closed position, panel 46 comprises the lower right-hand corner of the dispenser unit cabinet and is hinged at its back edge to, in effect, form a door which provides access to a $CO_2$ compartment 40 for containing a $CO_2$ cylinder 42 and a $CO_2$ regulator valve assembly 44. That is, access panel 46 has a right angle configuration which conforms to the shape of the lower right-hand corner of the dispenser cabinet to close the $CO_2$ supply compartment which is a cut-out in one corner of cabinet 12.

Figure 5:
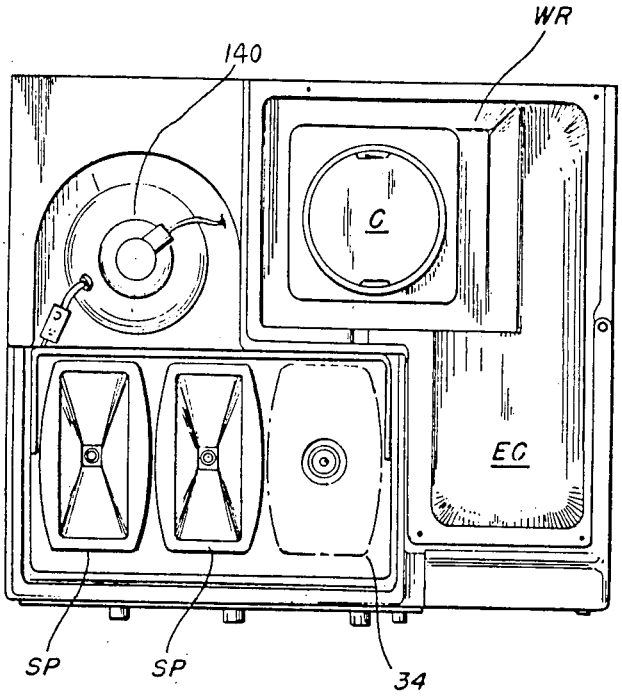
FIG. 5 is a top plan view of the dispenser unit with top access panels removed illustrating the relative location of the water reservoir to the entrance chute therefor.

The unique combination of the access panels 14 and 46 facilitates rapid set-up of the post-mix beverage system of the present invention and easy access for repair. With respect to set-up of the system, this may be achieved in the following manner. Front access panel 14 may be slid to a fully opened position, as illustrated in FIG. 2, and suitable syrup containers SP may be inverted, directing their discharge ends downwardly and plugged into sockets 36. Water may then be manually poured from a pitcher into water entrance chute EC whereby it flows down the chute into water reservoir WR disposed adjacent a back wall of the cabinet as indicated in FIG. 5. Front access panel 14 may then be closed to the fully closed position illustrated in FIG. 1. In the event that the dispenser unit had an adequate supply of syrup and only water need be added, the access panel 14 could be slid to the partially open position of FIG. 1, whereby only water entrance chute EC were exposed and water added as described above. The $CO_2$ cylinder 42 illustrated in FIG. 3 may then be added by inverting the $CO_2$ cylinder to direct the discharge opening downwardly and plugging the same into a socket 32 provided in the top surface of $CO_2$ regulator valve assembly 44. Thus, it can be seen that the necessary ingredients to be supplied to the post-mix beverage dispenser can be supplied in a rapid and efficient manner without cumbersome connections by virtue of the unique cabinetry design of the present invention which provides front access and the plug-in nature of both the syrup packages SP and $CO_2$ cylinder 42 of the present invention.

Figure 6:
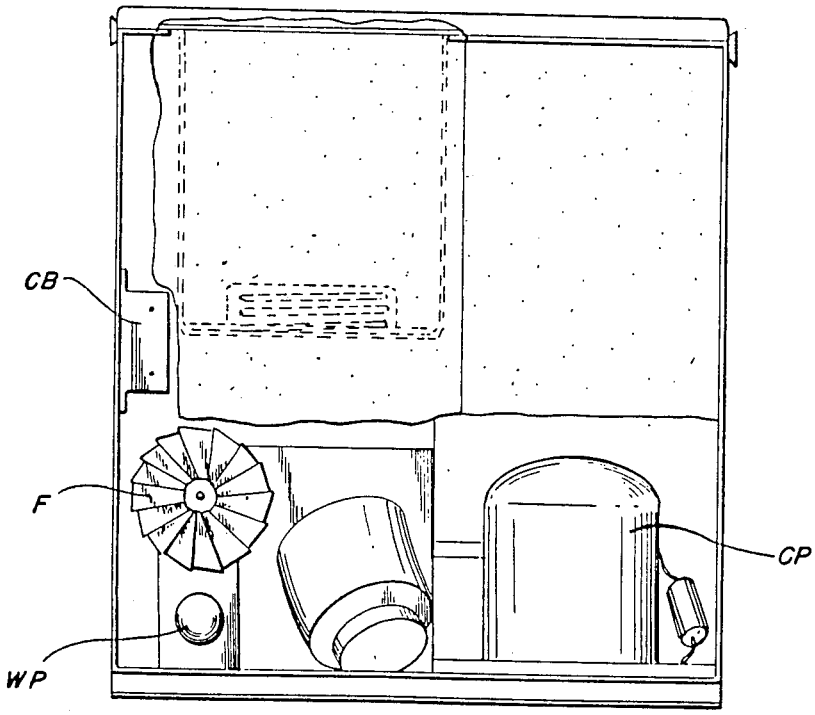
FIG. 6 is a rear elevational view of the dispenser unit of FIG. 1 with the rear panel removed to illustrate the refrigeration system of the dispenser.

The arrangement of the components of the mechanical refrigeration system of a preferred embodiment of the present invention and other mechanical components not described hereinabove is illustrated in FIG. 6. The compressor of the refrigeration system is indicated as CP, and is disposed directly below the carbonator compartment of the dispenser unit of the present invention. A circulating fan F is also provided, and disposed directly below the water reservoir WR for exhausting hot air from the dispenser cabinet. The evaporator of the refrigeration system is not illustrated in FIG. 6, but can be viewed in the top plan view of FIG. 5 as being in the bottom of the water reservoir WR. A water pump WP is disposed in the cabinet just below the fan F. The water pump, as will become more fully apparent, is provided to pump water from the water reservoir WR into the carbonator tank CT on demand. The electrical controls for operating the dispensing system of the present invention are housed in a box CB just below the fan F, as illustrated in FIG. 6.

In further reference to the plug-in nature of the syrup packages SP and $CP_2$ supply cylinder 42, the specific structure of the valve assemblies and associated containers to be used with the dispenser unit of the present invention are described in prior co-pending applications assigned to the sane assignee as the present invention. For example, the specific dispensing valve assembly 18 and mixing nozzles 20 contemplated for use with the present invention are described in prior application Ser. No. 084,434, filed Oct 12, 1979 to Jason K. Sedam and William R. Fuerst, which is now U.S. Pat. No. 4,306,667. The specific socket for the valve assembly 18 contemplated for use with the present invention is described in applicant's prior application Ser. No. 311,645, filed Oct. 15, 1981, which is now U.S. Pat. No. 4,426,019. The specific $CO_2$ cylinder construction to be used for cylinder 42 and the associated $CO_2$ regulator valve socket and assembly to be used with the dispenser unit of the present invention is described in applicant's prior application Ser. No. 277,806, filed June 26, 1981, which is now U.S. Pat. No. 4,357,284. The disclosures of each of these aforementioned prior applications are incorporated herein by reference.

The preferred embodiments of the syrup packages SP to be utilized with the present invention are described in U.S. Pat. No. 4,216,885 to Jason K. Sedam, issued Aug. 12, 1980, and the particular shape of the package is disclosed in U.S. Pat. No. Des. 273,768, issued May 8, 1984 to Jason K. Sedam and Simon J. Richter. As disclosed in the prior Sedam U.S. Pat. No. 4,216,885, the syrup package SP is provided with a flow control tube therein which is vented to the atmosphere through the bottom of the container after the container is plugged into socket 36. Containers SP are also provided with frangible seals or membranes over the discharge openings thereof and are punctured by a knife or cutting means of the type described in U.S. Pat. No. 4,426,019, mentioned above.

The $CO_2$ cylinder 42 to be used with the dispenser unit of the present invention is of the type described in the aforementioned Sedam U.S. Pat. No. 4,357,284 which has a dip tube therein to facilitate the dispensing of $CO_2$ gas from the container in an inverted position such as that which occurs when the discharge end is plugged into a socket in the top of $CO_2$ regulator valve assembly 44.

Figure 4:
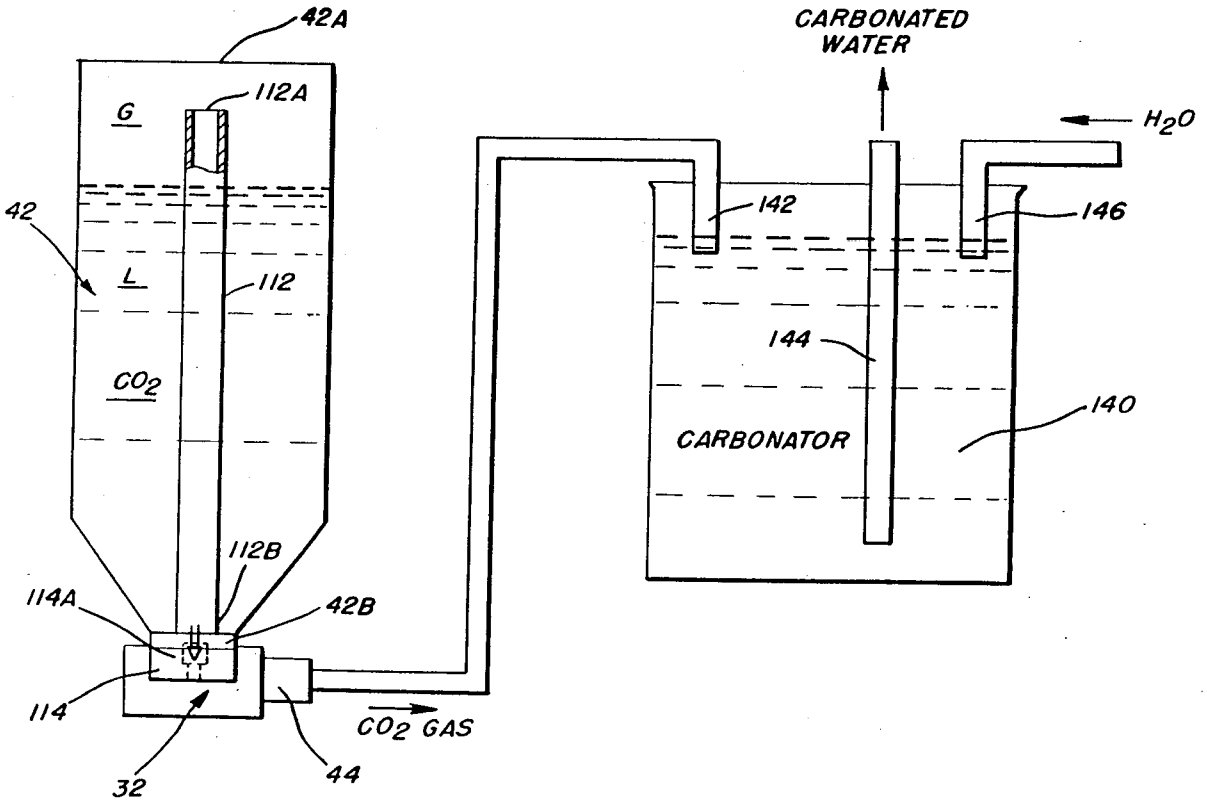
FIG. 4 is a diagrammatic view of the $CO_2$ cylinder structure, pressure regulator valve socket and carbonator system of applicant's U.S. Pat. No. 4,357,284 which is incorporated herein by reference.

Referring in further detail to FIG. 4, there is illustrated a $CO_2$ cylinder generally indicated 42, which includes both liquid and gaseous $CO_2$ under a pressure of approximately 900 p.s.i.g. The cylinder 42 has an open end 42B defined by a narrow neck portion which is coupled to a plug-shaped extension 114, which plugs into an adaptor socket 32. Adaptor socket 32 supports the entire weight of the cylinder 10 and contains suitable resilient sealing means for sealing plug-shaped extension 114 therein. Plug-shaped extension 114 also contains a valve 114A therein which opens in response to the insertion of cylinder 42 into socket 32, providing a fluid path from cylinder 42 to a pressure regulator 44. Pressure regulator 44 is connected to the adaptor 32 and also to a $CO_2$ gas dispensing hose 142 running from the regulator to a carbonator tank 140. The carbonator tank may be of any conventional variety, and, of course, also includes a water inlet tube 146 and a carbonator water outlet tube 144.

The $CO_2$ cylinder 42 contains both a liquid phase L and a gaseous phase G with, because of their differences in weight, occupy different portions of the cylinder 42. That is, the gaseous phase G is at the top of the container, as illustrated adjacent the closed end 42A of the cylinder and the liquid phase L is disposed at the bottom thereof adjacent the open end 42B of the cylinder. An elongated tube 112, open at both ends 112A and 112B, is disposed within the cylinder, end 112B being supported within a socket of plug-shaped extension 114 and end 112A being disposed in spaced relation to the closed end 42A of the cylinder in communication with the gaseous phase G of the material therein. Extension 114 is inserted in the open end 42B of cylinder 42.

In operation, the $CO_2$ cylinders for use with the present invention may be quickly inserted and removed from the adaptor socket 32 simply by plugging them into or withdrawing them from adaptor socket 32. Because of the presence of elongated tube 112 within the interior of cylinder 42, the gaseous $CO_2$ in the head space adjacent closed end 42A of the cylinder, can be withdrawn through the tube, through the valve 114A and into the pressure regulator as soon as the valve is opened by the insertion of the cylinder into the socket 32.

As stated hereinbefore, if the cylinder 42 is inverted from the positions illustrated in the drawing, the liquid phase will move to the closed end of the container adjacent the open end of elongated tube 112 and only liquid can be withdrawn through the tube 112.

Thus, it can be seen, because of the novel construction of the $CO_2$ cylinder 42 of the present invention, including the elongated tube 112, that $CO_2$ supply cylinders may be quickly and efficiently replaced without the need for any threaded connections or special tools. Thus, when a particular $CO_2$ cylinder 42 becomes empty and needs replacement, an operator may simply pick up another cylinder and plug it into adaptor socket 32, which provides an instantaneous connection to the pressure regulator and carbonator tank.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A self-contained, portable post-mix, carbonated beverage dispenser apparatus for use on a counter top comprising:

(a) a cabinet having front, side, back, top and bottom walls and a base for supporting the cabinet on a counter top;

(b) a self-contained refrigeration means disposed within said cabinet;

(c) a carbonator including a carbonator tank for holding a supply of water to be carbonated;

(d) a manually refillable water reservoir, separate from, but coupled in fluid communication with said carbonator tank, said reservoir being disposed within the cabinet in a substantially non-removable manner for supplying water to said carbonator tank, said water reservoir having an upwardly facing entrance opening means contiguous to said front and side walls and accessible through said top wall for receiving a manually introduced water supply so that water can be manually poured into said reservoir without removing said reservoir from said cabinet and without repositioning said cabinet on said counter top;

(e) at least one replaceable flavor concentrate container disposed contiguous to said front wall;

(f) at least one replaceable $CO_2$ cylinder disposed contiguous to said front wall for supplying $CO_2$ gas to said carbonator tank;

(g) access means for the water entrance opening means, flavor concentrate container, and $CO_2$ cylinder, permitting water, flavor concentrate containers and $CO_2$ cylinders to be introduced into said cabinet at positions contiguous to the front wall thereof; and (h) a dispensing station at said front wall for delivering a post-mix, carbonated beverage formed from a mixture of flavor concentrate and carbonated water.

2. The apparatus of claim 1, wherein said dispensing station includes a valve assembly for each flavor concentrate container and a dispensing nozzle for each valve assembly.

3. The apparatus of claim 1, wherein said water reservoir is disposed adjacent said back wall of said cabinet and a conduit connects said reservoir to said entrance opening means.

4. The apparatus of claim 3, wherein said conduit slopes downwardly from said entrance opening means to said water reservoir.

5. The apparatus of claim 1, wherein three of said flavor concentrate containers are disposed contiguous to said front wall.

6. The apparatus of claim 5, wherein said flavor concentrate containers have substantially flat sidewalls and are supported side-by-side, parallel to said front wall above said dispensing station.

7. The apparatus of claim 6, wherein said dispensing station includes a valve assembly for each flavor concentrate container and a dispensing nozzle for each valve assembly.

8. The apparatus of claim 7, wherein said dispensing station includes a recess in said front wall below said syrup concentrate containers into which said dispensing nozzles extend and a support surface at the bottom of said recess for drinking containers to be filled with the carbonated beverage.

* * * * *